US010688778B2

(12) United States Patent
Fromm et al.

(10) Patent No.: US 10,688,778 B2
(45) Date of Patent: Jun. 23, 2020

(54) PRINTER AND SUBSTRATE COOLER FOR PRESERVING THE FLATNESS OF SUBSTRATES PRINTED IN INK PRINTERS

(71) Applicant: Xerox Corporation, Norwalk, CT (US)

(72) Inventors: Paul M. Fromm, Rochester, NY (US); Erwin Ruiz, Rochester, NY (US); David A. VanKouwenberg, Avon, NY (US); Linn C. Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 3 days.

(21) Appl. No.: 16/127,798

(22) Filed: Sep. 11, 2018

(65) Prior Publication Data

US 2020/0079074 A1 Mar. 12, 2020

(51) Int. Cl.

| | |
|---|---|
| ***G03G 15/20*** | (2006.01) |
| ***B41F 31/00*** | (2006.01) |
| ***B41J 11/00*** | (2006.01) |

(52) U.S. Cl.

CPC ..... *B41F 31/002* (2013.01); *B41J 11/002* (2013.01); *B65H 2301/5144* (2013.01); *B65H 2404/1361* (2013.01)

(58) Field of Classification Search

CPC ..... B41F 31/002; B41J 11/002; B41J 3/28; B65H 2301/5144; B65H 2404/1361; G03G 21/206; G03G 15/2017; G03G 15/2021; G03G 15/20

USPC ..... 347/4, 101, 102

See application file for complete search history.

(56) References Cited

U.S. PATENT DOCUMENTS

| | | | | |
|---|---|---|---|---|
| 7,505,725 | B2 | 3/2009 | Katayama et al. | |
| 9,372,465 | B2 * | 6/2016 | Ikeda | G03G 15/6573 |
| 9,625,861 | B2 | 4/2017 | Okuda | |
| 10,175,646 | B2 * | 1/2019 | Kutsuwada | G03G 21/206 |
| 2007/0071522 | A1 | 3/2007 | Kaji et al. | |
| 2011/0030927 | A1 | 2/2011 | Okano et al. | |
| 2012/0074638 | A1 | 3/2012 | Nakagaki | |
| 2014/0186080 | A1 * | 7/2014 | Ikeda | G03G 15/6573 399/341 |
| 2016/0216689 | A1 * | 7/2016 | Kiuchi | G03G 15/2017 |

* cited by examiner

*Primary Examiner* — Thomas A Morrison

(74) *Attorney, Agent, or Firm* — Maginot Moore & Beck LLP

(57) ABSTRACT

An imaging system includes a substrate cooler that reduces the temperature of substrates bearing dried ink images. The substrate cooler has a plurality of rollers, at least one actuator operatively connected to the plurality of rollers, and a controller operatively connected to the least one actuator. The controller is configured to operate the at least one actuator to move the rollers relative to one another to vary the length of the path along which the substrates move through the substrate cooler.

10 Claims, 5 Drawing Sheets

PRINTER AND SUBSTRATE COOLER FOR PRESERVING THE FLATNESS OF SUBSTRATES PRINTED IN INK PRINTERS

TECHNICAL FIELD

This disclosure relates generally to aqueous ink printing systems, and more particularly, to media treatment systems in such printers.

BACKGROUND

Known aqueous ink printing systems print images on substrates. Whether an image is printed directly onto a substrate or transferred from a blanket configured about an intermediate transfer member, once the image is on the substrate, the water and other solvents in the ink must be substantially removed from the surface to fix the image to the substrate. A dryer is typically positioned after the transfer of the image from the blanket or after the image has been printed on the substrate for removal of the water and solvents. To enable relatively high speed operation of the printer, the dryer uniformly heats the entire substrate and ink to temperatures that typically reach 100° C. and up to 140° C. in some cases. As the dried substrates move on the media transport path through the printer, they are cooled so they can be handled when they are discharged into the output tray.

One problem that arises during the drying of the aqueous ink images on substrates is the absorption of the water and other solvents into the substrates, particularly when the substrates are fibrous, such as paper. The absorption of the water and other solvents can wrinkle or otherwise distort the flatness of the substrates. Even after drying, the substrate can retain this uneven surface. As the substrates fill the output tray, this unevenness can present issues for stacking the printed substrates in the tray and the degree of unevenness in the surface of the substrates can impact the desirability of the printed sheets for the user. Being able to retain the original flatness of the substrates after the aqueous ink images on the substrates have been dried would be beneficial.

SUMMARY

A new imaging system includes a substrate cooler that preserves the flatness of printed substrates bearing dried ink images. The imaging system includes at least one marking material device configured to form images on substrates, a media transport system configured to move the substrates past the at least one marking material device to enable the at least one marking material device to form images on the substrates, a first dryer configured to dry the substrates after the at least one marking material device has formed images on the substrates, and a substrate cooler configured to receive the substrates after the substrates have been dried by the dryer, the substrate cooler being configured to vary a length of a path along which the substrates move through the substrate cooler.

A new substrate cooler for an ink printing system preserves the flatness of printed substrates bearing dried ink images. The substrate cooler includes a plurality of rollers, at least one actuator operatively connected to the plurality of rollers, and a controller operatively connected to the least one actuator, the controller being configured to operate the at least one actuator to move the rollers relative to one another to vary the length of the path along which the substrates move through the substrate cooler.

BRIEF DESCRIPTION OF THE DRAWINGS

The foregoing aspects and other features of an ink printing system that includes a substrate cooler that preserves the flatness of printed substrates while efficiently cooling the dried substrates are explained in the following description, taken in connection with the accompanying drawings.

DETAILED DESCRIPTION

Figure 1:
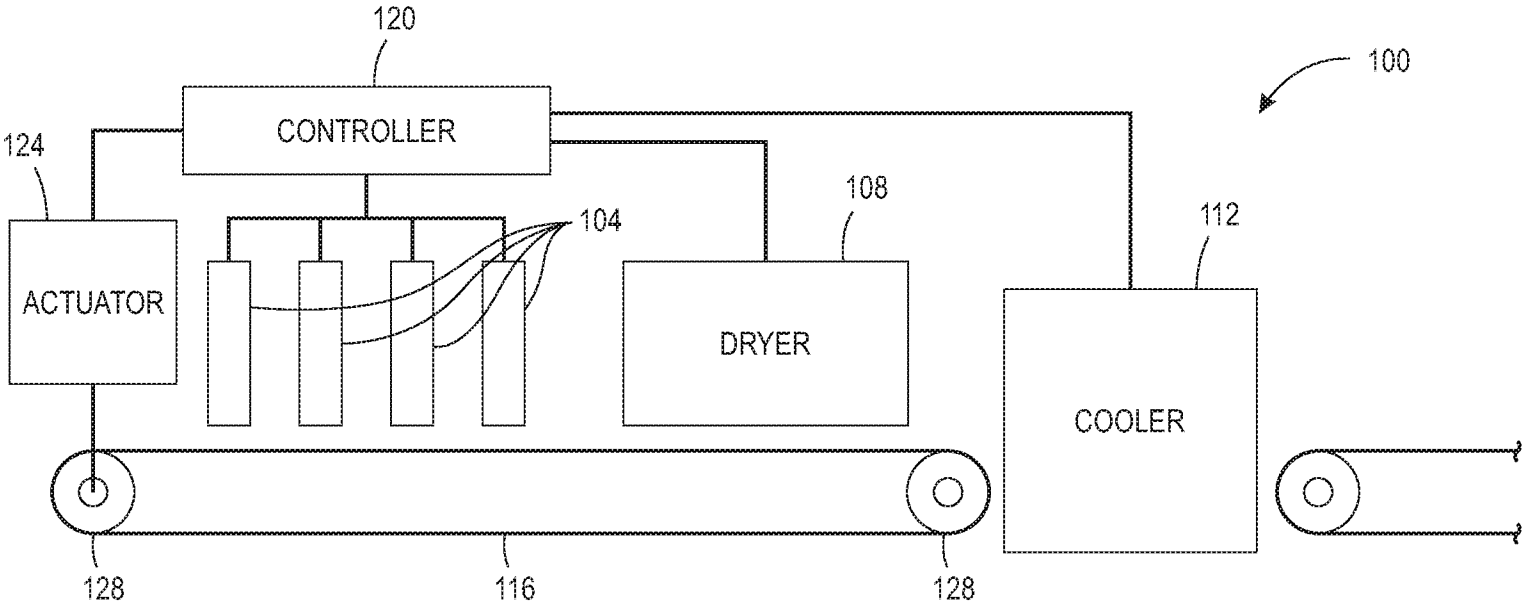
FIG. 1 is a block diagram of an aqueous ink printing system that enables efficient cooling of dried substrates bearing aqueous ink images while preserving the flatness of the printed substrates.

For a general understanding of the present embodiments, reference is made to the drawings. In the drawings, like reference numerals have been used throughout to designate like elements.

FIG. 1 depicts a block diagram of an aqueous printing system 100 that is configured to preserve the flatness of printed substrates while drying aqueous ink images printed on the substrates. Although the system 100 is an aqueous printing system and is used to explain the structures and principles of operation of the substrate cooler 112, the cooler of this printer can be used in printers using other types of ink such as ink emulsions, inks made with other solvents, pigmented inks, ultraviolet (UV) curable inks, gel inks, solid inks, and the like and as well as printers that use toners and other marking materials to form images on substrates, such as xeroxgraphy. As used in this document, the term "imaging system" means any system that forms images on substrates using any type of marking material. Thus, while the exemplary system 100 described below includes an ink printhead other type of components can be used to form images with marking materials on the substrates. As used in this document, the term "marking material device" means any device that applies a marking material, such as ink, toner, or the like, to a substrate to form an image on the substrate.

The system 100 in FIG. 1 includes one or more arrays 104 of printheads, a dryer 108, a substrate cooler 112, a transport belt 116, a controller 120, an actuator 124, and rollers 128. As used in this document, the term "dryer" refers to a device that subjects printed images on substrates with a form of energy that removes a liquid or a solvent from the printed image. As used in this document, the term "substrate cooler" refers to a device that receives substrates bearing at least partially dried ink images and is configured to reduce the temperature of the substrates to a level at which the substrates are tolerable to human touch. The transport belt 116 is an endless belt configured about two or more rollers 128, at least one of which is driven by the actuator 124 that is operated by the controller 120 to rotate the belt about the rollers 128 to move substrates past the printheads 104 for printing, through the dryer 108, and into the cooler 112 for substrate conditioning. As used in this document, the term "cross-process direction" refers to the direction perpendicular to the direction of substrate movement past the printheads and through the dryer and substrate cooler that also lies in the plane of the substrate. The term "process direction" as used in this document refers to the direction of substrate movement past the printheads and through the dryer and the substrate cooler that also lies in the plane of the substrate.

The printhead arrays 104 are operated by the controller 120 in a known manner to eject drops of aqueous ink onto the substrates passing by them to form ink images on the substrates. The dryer 108 is configured with energy emitting devices that remove water and other solvents from a printed image on a substrate. The substrate cooler 112 reduces the temperature of the dried substrates in a manner that retains the flatness of the substrates. The printer output or the cooler 112 can terminate into an output tray or transition to another media transport path to enable additional processing of the printed substrates. Although a single controller 120 is shown in FIG. 1 for operating the dryer 108, the substrate cooler 112, and the printhead arrays 104, two or more controllers or other logic units, processors, or the like, can be used to operate the dryer, the cooler, and the printhead arrays separately and independently with the different controllers communicating with one another to synchronize the operations of these devices as described below.

Figure 2:
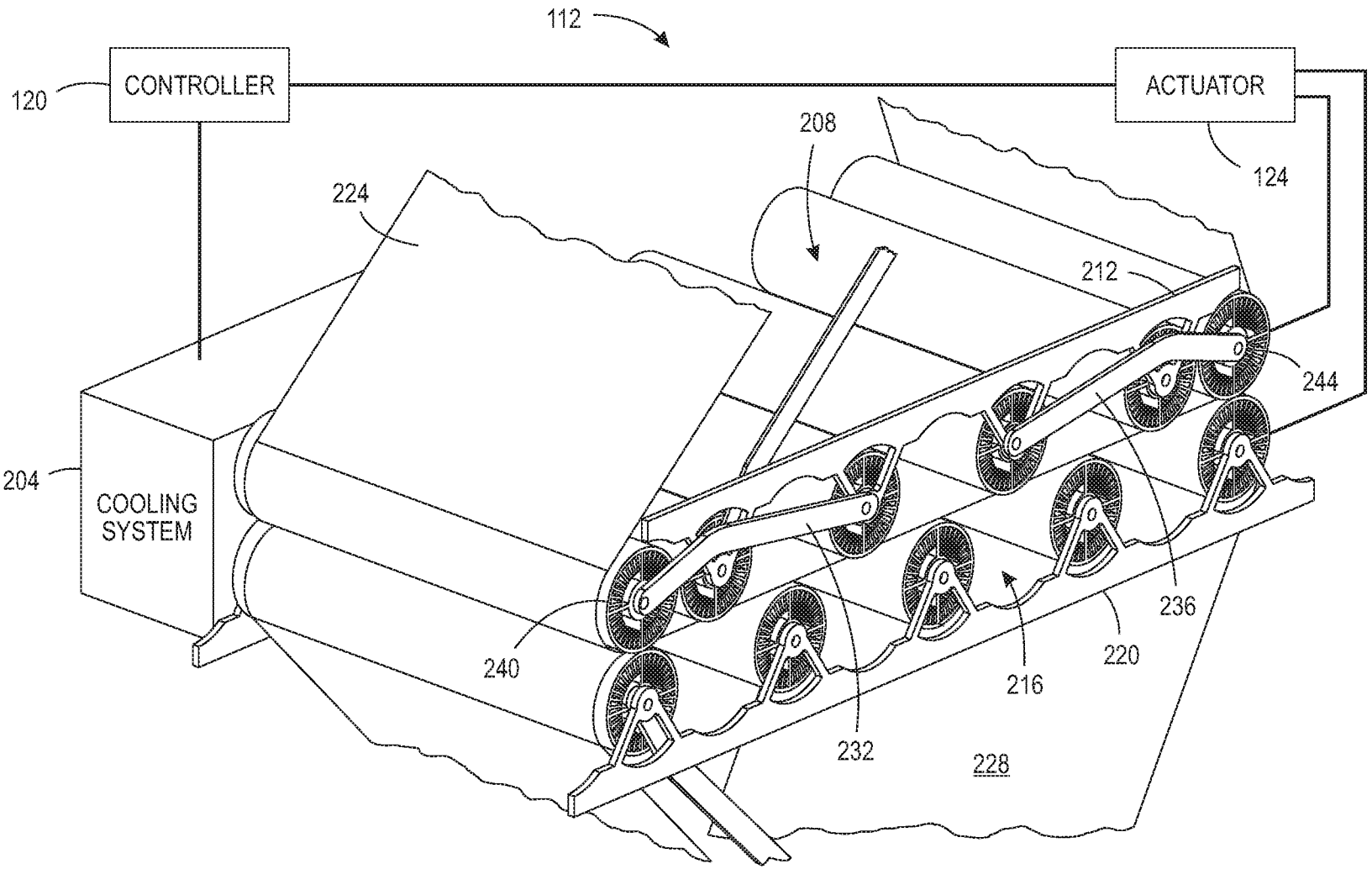
FIG. 2 is a partial perspective view of one embodiment of a substrate cooler that can be used in the printer of FIG. 1.

FIG. 2 is a partial perspective view of the substrate cooler 112. The controller 120 or another controller configured to operate the cooler is operatively connected to a cooling system 204 and at least one other actuator 124. As used in this document, the term "cooling system" means a combination of components that removes heat from the elements of a substrate cooler that absorb heat from the substrates passing through the substrate cooler. One set of four rollers 208 is mounted to an upper arm 212 and another set of five rollers 216 is mounted to a lower arm 220. The lower arm 220 is fixedly mounted to structure in the cooler 112 and the rollers in the set of rollers 216 are separated from one another by a equal distance. The upper arm 212 is configured to move bidirectionally toward and away from the lower arm 220. A bent link 232 connects one of the rollers mounted to upper arm 212 to a leading roller 240 and another bent link 236 connects another of the rollers mounted to upper arm 212 to a trailing roller 244. An upper endless belt 224 is wrapped about the set of rollers 208, the leading and trailing rollers 240 and 244, and an upper roller 304 (FIG. 3) to adjust the tension of the belt 244 about the rollers. A lower belt 228 is wrapped about the set of rollers 216 and a lower roller 308 (FIG. 3) to adjust the tension of the belt about the rollers. The number of rollers in each set 208 and 216 can be more or less than shown provided a difference of one roller between the sets is maintained.

Figure 3A:
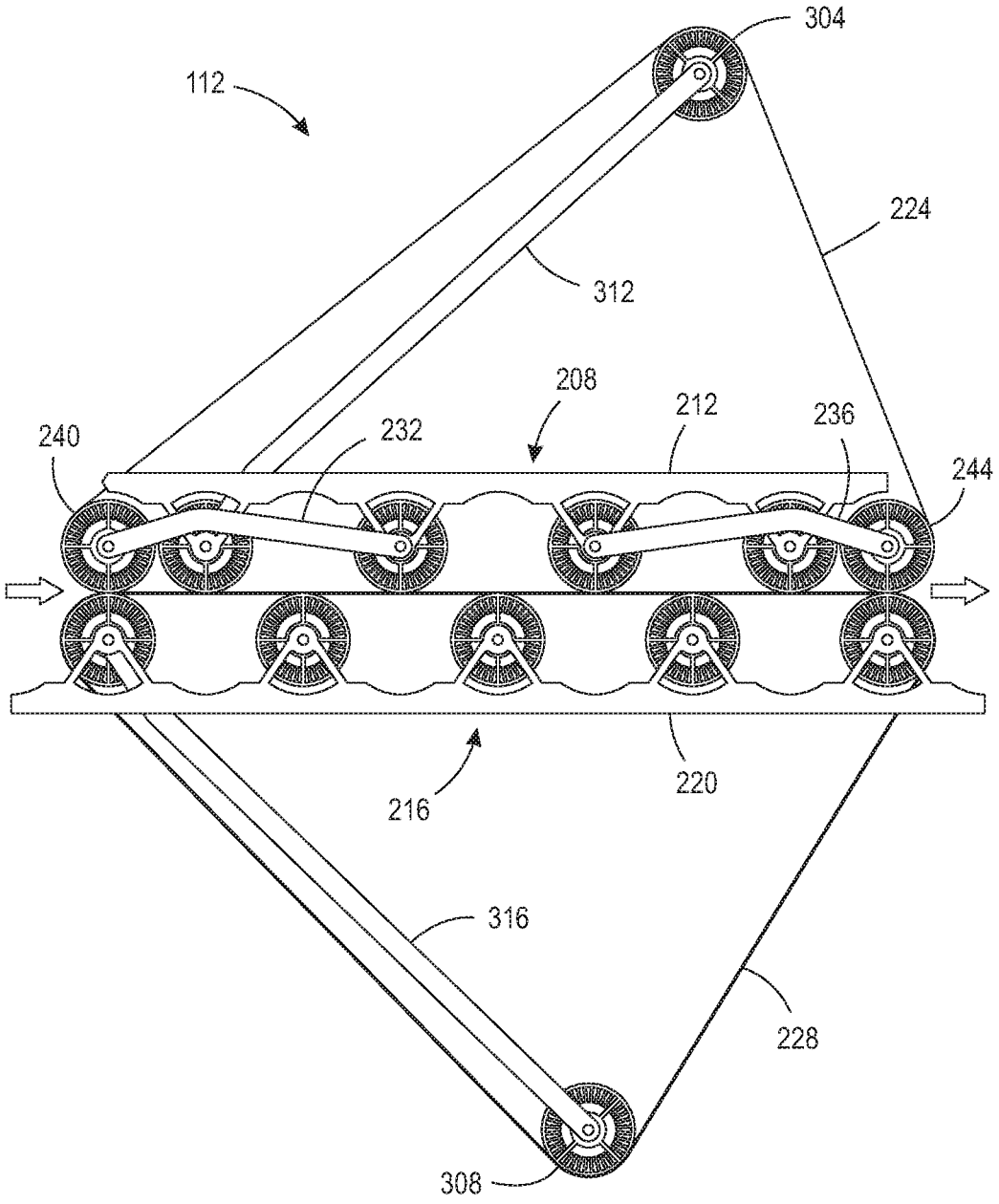
FIG. 3A is a side view of the substrate cooler shown in FIG. 2 positioned for minimal engagement with the printed substrates.

A side view of the cooler 112 is shown in FIG. 3A. The upper roller 304 is rotatably mounted to one end of a straight link 312 and the second end of the straight link 312 is pivotally mounted about the shaft about which the forwardmost roller in the set of rollers 208 is mounted. This straight link 312 rotates about that shaft to move the upper roller 304 toward and away from the trailing roller 244 to adjust tension in the belt 224 as the upper arm 212 moves with respect to the lower arm 220. The lower roller 308 is rotatably mounted to one end of a straight link 316 and the second end of the straight link 316 is pivotally mounted about the shaft about which the forwardmost roller in the set of rollers 216 is mounted to adjust tension in the belt 228 as the upper arm 212 moves with respect to the lower arm 220. Although the embodiment shown in FIG. 3A uses straight links for tension adjustment as the upper arm moves, other tension adjusting devices, such as biasing members or springs could be used. The straight link 316 rotates about that shaft to move the lower roller 308 toward and away from the last roller mounted to the lower arm 220 in the process direction. The process direction is indicated by the arrow in the figure. When the upper roller 304 and the lower roller 308 are positioned as shown in FIG. 3A, the belts 224 and 228 have minimal contact with one another. This section of the two belts where they meet one another is aligned with the transport belt 116 so substrates that have been printed by the printheads 104 and dried by the dryer 108 can enter the cooler 112 for temperature treatment of of the substrates. The dryer 108 can be variably controlled by the controller 120 to adjust the temperature at which the substrates are dried. This temperature is adjusted with reference to the amount of ink coverage on the substrates, the type of substrate, and other similar factors related to evaporation of water and other solvents from the printed image. When these factors enable the controller to operate the dryer 108 at a lower temperature, the straight path through the cooler 112 shown in FIG. 3A is sufficient to cool the substrates and maintain their flatness for the remaining processing to be performed in the printer.

Figure 3B:
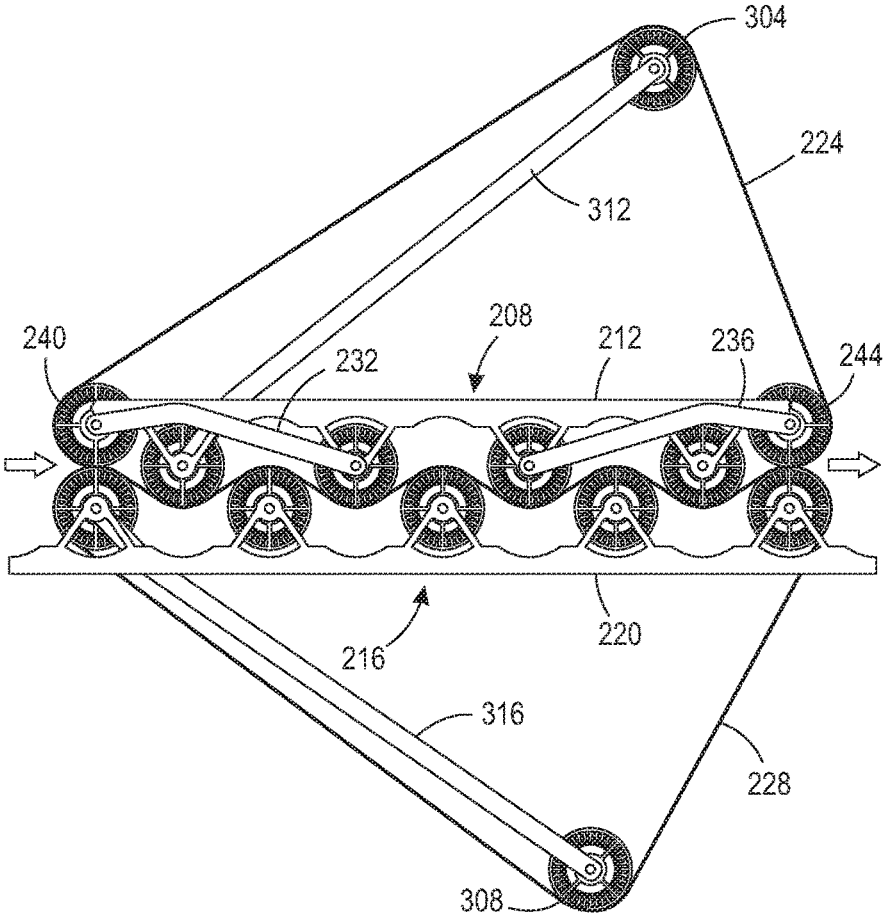
FIG. 3B is a side view of the substrate cooler shown in FIG. 3A positioned for fifty percent of the maximum engagement of the printed substrates with the two belts of the cooler.

In FIG. 3B, the controller 120 has operated one of the actuators 124 to move the upper arm 212 toward the lower arm 220 and to move the upper roller 304 toward the trailing roller 244. Also, the controller 120 has operates the same or another actuator 124 to move the lower roller 308 toward the last roller mounted to the lower arm 220 in the process direction. The tension on the belts 224 and 228 enable the upper arm 212 and the set of rollers 208 to interleave with the set of rollers 216 on the lower arm 220. Alternatively, the links 312, 316, 232, and 236 can be spring loaded. In this embodiment, the actuator 124 moves the upper frame 212 and the rest of the links move in response to the belt path length change. The constant force on links 312 and 316 maintain constant belt tension and the constant force on links 232 and 236 maintain a constant nip force in this embodiment. As used in this document, the term "interleave" means the rollers mounted to one arm alternate with the rollers mounted to the other arm in the process direction. As shown in the figure, the rollers in the set of rollers 208 interleave with the rollers in the set of rollers 216 while the bent link 232 enables the leading roller 240 to maintain the nip with the leading roller of the set of rollers 216 to enable the leading edge of substrates entering the substrate cooler to be captured and pulled through the cooler 112. Likewise, the bent link 236 enables the last roller mounted to the upper arm 212 to move between the last two rollers mounted to the lower arm 220 while the trailing roller 244 maintains the nip between that roller and the last roller mounted to the lower arm 220. The undulating path formed by the rollers in the cooler 112 is longer than the path shown in FIG. 3A so the substrate is subjected to cooling effects longer. As used in this document, the term "undulating path" means a structure for conveying substrates tht has curvature that bends the substrates in opposite direction as the substrates move along the structure. These cooling effects are discussed in more detail below. The undulating path bends the substrate in two opposed directions and this bending has the effect of restoring flatness to the substrates. Thus, when the substrates exit the nip between trailing roller 244 and the last roller on the lower arm 220, they are relatively flat and cooled.

Figure 3C:
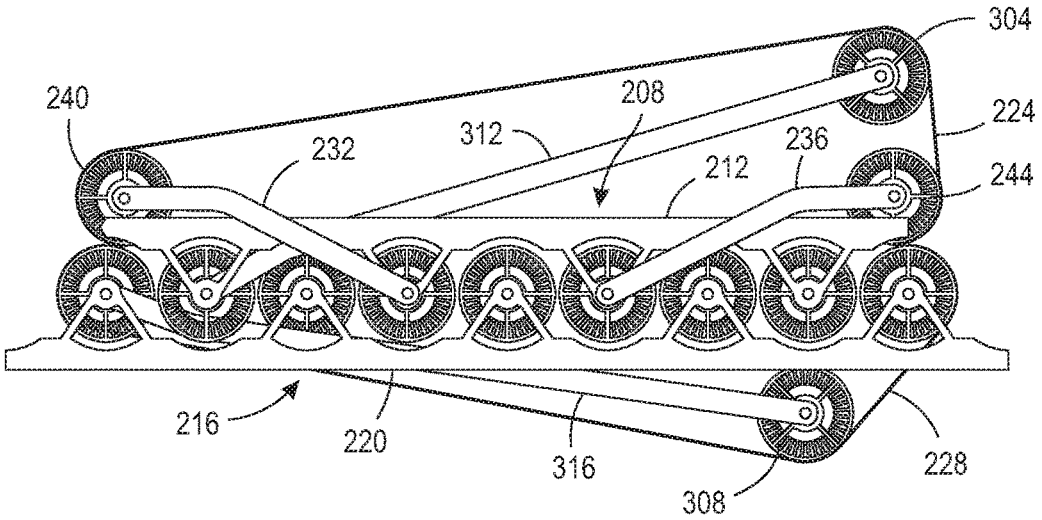
FIG. 3C is a side view of the substrate cooler shown in FIG. 3A and FIG. 3B positioned for maximum engagement of the printed substrates with the two belts of the cooler.

In FIG. 3C, the controller 120 has operated an actuator 124 to move the upper arm to its closest position to the lower arm 220 and its also move the upper roller 304 to a minimal distance from the trailing roller 244. The controller 120 also operates the same or another actuator 124 to move the lower roller 308 to a minimal distance from the last roller mounted to the lower arm 220 in the process direction. The tension on the belts 224 and 228 enable the upper arm 212 and the set of rollers 208 to move to its closest position to the lower arm 220 and the set of rollers 216 as depicted in the figure. This action interleaves the rollers in the set of rollers 208 with the rollers in the set of rollers 216 while the bent link 232 enables the leading roller 240 to maintain the nip with the leading roller of the set of rollers 216 to enable entering the leading edge of substrates to be captured and pulled through the cooler 112. Likewise, the bent link 236 enables the last roller mounted to the upper arm 212 to move almost diametrically opposite the last two rollers mounted to the lower arm 220 while the trailing roller 244 maintains the nip between that roller and the last roller mounted to the lower arm 220. The undulating path formed by the rollers in the cooler 112 is now at a maximum length so the substrate is subjected to cooling effects for a maximum period of time. Additionally, the undulating path bends the substrate in two opposed directions by a maximum amount and this bending has the effect of restoring flatness to the substrates that received a maximum of ink and were subjected to the greatest temperature generated by the dryer 108. Thus, when the substrates exit the nip between the trailing roller 244 and the last roller on the lower arm 220, they are relatively flat and cooled.

Figure 4A:
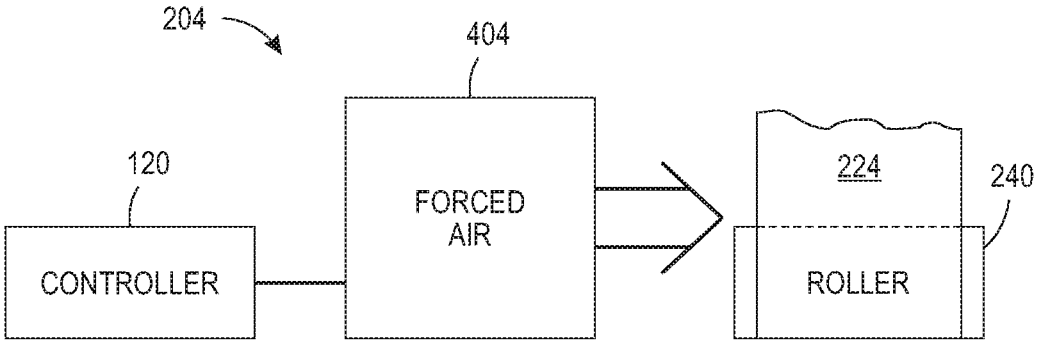
FIG. 4A is a block diagram of one embodiment of the cooling system shown in FIG. 2.

FIG. 4A is a block diagram of the cooling system 204. In the embodiment of FIG. 4A, controller 120 operates a forced air source 404, such as a fan or the like, to direct air longitudinally through the rollers, such as roller 240 shown in FIG. 4A, and through the space between the roller sets 208 and 216 mounted to the upper and lower arms 212 and 220, respectively, and through the upper and lower rollers 304 and 308. The air directed by the forced air source 404 can be pulled from the ambient air in the vicinity of the printer or some other source of relatively cool air. The air flowing through the rollers absorbs heat from the walls of the rollers that absorbed heat from the belt about the rollers that absorbed heat from the substrates. The air flow in the space between the roller sets and the upper or lower rollers that adjust the degree of belt engagement absorbs heat directly from the belts. The air heated by absorption is exhausted from the cooler 112 and replaced with cool air from the forced air source. The substrates are engaged on both sides by the belts 224 and 228 and this continuous contact helps the heat exchange between the belts and the substrates. Additionally, the relative displacement between the set of rollers 208 and the set of rollers 216 varies the degree of curvature in the substrate path and the length of the path to vary the amount of thermal conduction between the belts and the substrates. Also, the controller 120 can adjust the speed at which the actuator 124 drives the rollers in the cooler 112 to alter the amount of time that substrates remain in the substrate cooler. The type of belts also affect the cooling characteristics of the substrate cooler. Belts made of thin materials, such as 0.1 mm polyester or Kapton, are good thermal conductors that provide little resistance to the flow of heat from the substrates to the rollers. Belts made of thicker materials, such as 1 mm rubber, absorb heat and then release it to the rollers and as the belt rotates in the space where the belt does not engage the rollers. Thin and thick belts act similarly to each other but thick belts have a significant energy storage term of the heat balance equations while this term is much smaller with thin belts. Thus, heat loss from thick belts not in contact with the substrate is more significant than the heat loss of thin belts is the same situation.

Figure 4B:
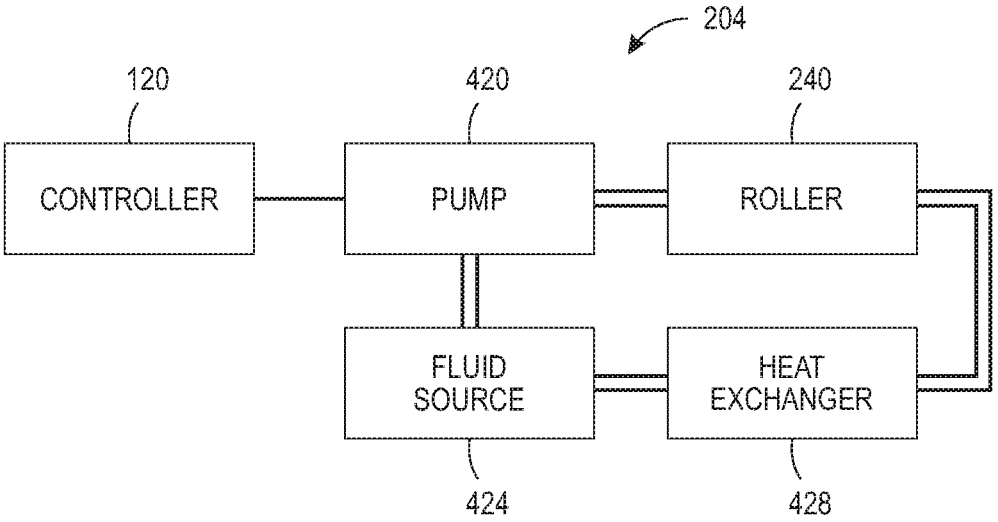
FIG. 4B is a block diagram of one embodiment of the cooling system shown in FIG. 2.

FIG. 4B shows an alternative cooling system 204. In this embodiment, the controller 120 operates a pump 420 that pulls fluid from a fluid source 424 and directs it through conduits near the inner walls of the rollers or into the interior volumes of the rollers that are sealed with an ingress for the fluid on one end and an egress for the fluid on the other end. The fluid in the interior of the rollers absorbs heat from the rollers and then flows through a heat exchanger 428, such as a radiator, where the fluid is cooled. The cooled fluid is then returned to the fluid source 424 for another cycle through the rollers and the heat exchanger. In this embodiment, the belts are cooled only by contact with the rollers.

In operation, the substrate cooler 112 is installed in a printer to receive substrates from a dryer in the printer. The controller 120 operates actuators 124 to move the upper arm 212 with respect to the lower arm 220 and also moves the upper and the lower rollers 304 and 308 to an appropriate position for the distance between the two sets of rollers. The distance between the arms 212 and 220 and the positions of the upper and lower rollers 304 and 308 are determined with reference to the temperature to which the substrates have been exposed in the dryer. The controller 120 also operates the actuators driving one or more of the rollers in the cooler to rotate the belts at a predetermined speed corresponding to the length of the substrate path through the substrate cooler. The controller 120 can operate these actuators to adjust the length of the path through the substrate cooler and the speed at which the substrates move to through the cooler to accommodate the different temperatures to which the substrates are exposed. The controller 120 operates the cooling system 204 to enable heat exchange between the belts, rollers, and the fluid flow in the substrate cooler.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An imaging system comprising:

at least one marking material device configured to form images on substrates;

a media transport system configured to move the substrates past the at least one marking material device to form with the at least one marking material device images on the substrates;

a first dryer configured to dry the substrates after the at least one marking material device has formed images on the substrates; and a substrate cooler configured to receive the substrates after the substrates have been dried by the dryer, the substrate cooler comprising:

a plurality of rollers;

at least one actuator operatively connected to the plurality of rollers;

a controller operatively connected to the least one actuator, the controller being configured to operate the at least one actuator to move the rollers relative to one another to vary a length of a path along which the substrates move through the substrate cooler and to regulate a speed at which the rollers rotate with reference to a temperature to which the substrates were exposed in the dryer;

a cooling system having:

a fluid source;

a pump operatively connected to the fluid source and to the rollers;

a heat exchanger operatively connected to the rollers and to the fluid source; and the controller is also operatively connected to the pump, the controller being further configured to operate the pump to circulate fluid through the rollers, the heat exchanger, and the fluid source to absorb heat from the rollers.

2. The imaging system of claim 1 further comprising:

a first endless belt wrapped around a first predetermined number of rollers;

a first member having a first end and a second end, the first end of the first member being mounted about a shaft about which one roller of the first predetermined number of rollers rotates to pivot the first member about the shaft and the second end of the first member having a roller rotatably mounted to the second end of the first member, the roller rotatably mounted about the second end of the first member engaging an inner surface of the first endless belt;

the at least one actuator operatively connected to the roller rotatably mounted to the second end of the first member and to the first predetermined number of rollers, the at least one actuator being further configured to move the roller rotatably mounted to the second end of the first member toward and away from the first predetermined number of rollers;

a second endless belt wrapped around a second predetermined number of rollers;

a second member having a first end and a second end, the first end of the second member being mounted about a shaft about which one roller of the second predetermined number of rollers rotates to pivot the second member about the shaft and the second end of the second member having a roller rotatably mounted to the second end of the second member, the roller rotatably mounted about the second end of the second member engaging an inner surface of the second endless belt;

the at least one actuator operatively connected to the roller rotatably mounted to the second end of the second member and the second predetermined number of rollers, the at least one actuator being further configured to move the roller rotatably mounted to the second end of the second member toward and away from the second predetermined number of rollers; and the controller being further configured to operate the at least one actuator to move the roller rotatably mounted to the second end of the first member toward the first predetermined number of rollers and to move the first predetermined number of rollers toward the second predetermined number of rollers and to move the roller rotatably mounted to the second end of the second member toward the second predetermined number of rollers to interleave the first predetermined number of rollers with the second predetermined number of rollers so a portion of the first endless belt engaging the first predetermined number of rollers and a portion of the second endless belt engaging the second predetermined number of rollers form an undulating path between the first predetermined number of rollers and the second predetermined number of rollers through which the substrates move through the substrate cooler.

3. The imaging system of claim 2 wherein the first endless belt and the second endless belt are made of 0.1 mm thick polyester or Kapton.

4. The imaging system of claim 2 wherein the first endless belt and the second endless belt are made of 1 mm thick rubber.

5. The imaging system of claim 2, the controller being further configured to:

move the first predetermined number of rollers toward the second predetermined number of rollers to lengthen the undulating path between the first endless belt and the second endless belt and to move the first predetermined number of rollers away from the second predetermined number of rollers to shorten the undulating path between the first endless belt and the second endless belt.

6. A substrate cooler for an imaging system comprising:

a plurality of rollers;

at least one actuator operatively connected to the plurality of rollers; and a controller operatively connected to the least one actuator, the controller being configured to operate the at least one actuator to move the rollers relative to one another to vary a length of a path along which substrates move through the substrate cooler and to regulate a speed at which the rollers rotate with reference to a temperature to which the substrates were exposed in a dryer in the imaging system; and a cooling system having:

a fluid source;

a pump operatively connected to the fluid source and to the rollers;

a heat exchanger operatively connected to the rollers and to the fluid source; and the controller is also operatively connected to the pump, the controller being further configured to operate the pump to circulate fluid through the rollers, the heat exchanger, and the fluid source to absorb heat from the rollers.

7. The substrate cooler of claim 6 further comprising:

a first endless belt wrapped around a first predetermined number of rollers;

a first member having a first end and a second end, the first end of the first member being mounted about a shaft about which one roller of the first predetermined number of rollers rotates to pivot the first member about the shaft and the second end of the first member having a roller rotatably mounted to the second end of the first member, the roller rotatably mounted about the second end of the first member engaging an inner surface of the first endless belt;

the at least one actuator operatively connected to the roller rotatably mounted to the second end of the first member and to the first predetermined number of rollers, the at least one actuator being further configured to move the roller rotatably mounted to the second end of the first member toward and away from the first predetermined number of rollers;

a second endless belt wrapped around a second predetermined number of rollers;

a second member having a first end and a second end, the first end of the second member being mounted about a shaft about which one roller of the second predetermined number of rollers rotates to pivot the second member about the shaft and the second end of the second member having a roller rotatably mounted to the second end of the second member, the roller rotatably mounted about the second end of the second member engaging an inner surface of the second endless belt;

the at least one actuator operatively connected to the roller rotatably mounted to the second end of the second member and the second predetermined number of rollers, the at least one actuator being further configured to move the roller rotatably mounted to the second end of the second member toward and away from the second predetermined number of rollers; and the controller being further configured to operate the at least one actuator to move the roller rotatably mounted to the second end of the first member toward the first predetermined number of rollers and to move the first predetermined number of rollers toward the second predetermined number of rollers and to move the roller rotatably mounted to the second end of the second member toward the second predetermined number of rollers to interleave the first predetermined number of rollers with the second predetermined number of rollers so a portion of the first endless belt engaging the first predetermined number of rollers and a portion of the second endless engaging the second predetermined number of rollers form an undulating path between the first predetermined number of rollers and the second predetermined number of rollers through which the substrates move through the substrate cooler.

8. The substrate cooler of claim 7 wherein the first endless belt and the second endless belt are made of 0.1 mm thick polyester or Kapton.

9. The substrate cooler of claim 7 wherein the first endless belt and the second endless belt are made of 1 mm thick rubber.

10. The substrate cooler of claim 7, the controller being further configured to:

move the first predetermined number of rollers toward the second predetermined number of rollers to lengthen the undulating path between the first endless belt and the second endless belt and to move the first predetermined number of rollers away from the second predetermined number of rollers to shorten the undulating path between the first endless belt and the second endless belt.

* * * * *